United States Patent [19]

Umezaki

[11] Patent Number: 5,044,328

[45] Date of Patent: Sep. 3, 1991

[54] IGNITION DEVICE FOR INTERNAL COMBUSTION ENGINE

[75] Inventor: Tomokazu Umezaki, Hyogo, Japan

[73] Assignee: Mitsubishi Denki K.K., Tokyo, Japan

[21] Appl. No.: 598,586

[22] Filed: Oct. 17, 1990

Related U.S. Application Data

[63] Continuation of Ser. No. 371,855, Jun. 27, 1989, abandoned.

[30] Foreign Application Priority Data

Aug. 5, 1988 [JP] Japan ..... 63-194468

[51] Int. Cl.[5] ..... F02P 3/12

[52] U.S. Cl. ..... 123/647; 123/640

[58] Field of Search ..... 123/647, 634, 599, 478

[56] References Cited

U.S. PATENT DOCUMENTS

| | | | |
|---|---|---|---|
| 4,195,611 | 4/1980 | Wörz et al. | 123/647 |
| 4,198,943 | 4/1980 | Wörz | 123/647 |
| 4,248,201 | 2/1981 | Tsutsui et al. | 123/647 |
| 4,343,285 | 8/1982 | Brammer et al. | 123/647 |
| 4,392,473 | 7/1983 | Tsutsui et al. | 123/647 |
| 4,397,291 | 8/1983 | Johnson | 123/640 |
| 4,561,396 | 12/1985 | Sakamoto et al. | 123/647 |
| 4,587,942 | 5/1986 | Burson | 123/549 |
| 4,617,907 | 10/1986 | Johansson et al. | 123/647 |
| 4,637,368 | 1/1987 | Gillbrand et al. | 123/647 |
| 4,665,922 | 5/1987 | Gillbrand et al. | 123/647 |
| 4,671,248 | 6/1987 | Gillbrand et al. | 123/647 |
| 4,706,638 | 11/1987 | Johansson et al. | 123/647 |
| 4,766,869 | 8/1988 | de Concini et al. | 123/478 |

*Primary Examiner*—Raymond A. Nelli

*Attorney, Agent, or Firm*—Sughrue, Mion, Zinn, Macpeak & Seas

[57] ABSTRACT

An ignition device for an internal combustion engine comprises an ignition coil unit including a core a primary coil wound around said core, a secondary coil electro-magnetically coupled to the primary coil, a case for housing the core, the primary coil and the secondary coil therein, and control circuit for controlling a current flowing the primary coil. In the ignition device, the control circuit is housed in the case so that heat generated by said control circuit is transferred to the case to radiate out the heat.

4 Claims, 2 Drawing Sheets

IGNITION DEVICE FOR INTERNAL COMBUSTION ENGINE

This is a continuation of application Ser. No. 07/371,855 filed Jun. 27, 1989 now abandoned.

BACKGROUND OF THE INVENTION

The present invention relates to an ignition device for an internal combustion engine.

FIG. 1 is a diagram showing the principle of the operation of a major part of a conventional ignition device for an internal combustion engine. The device includes an ignition coil unit 1 and an igniter 2 which are housed in mutually separate cases, respectively. The case housing the igniter 2 is secured to that housing the ignition coil unit 1, or is disposed in a distributor not shown in FIG. 1. Since the cases are separately provided, the device has problems that it is large in size and cost and the mounting property of the device is not good.

SUMMARY OF THE INVENTION

The present invention was made in order to solve the above-mentioned problems.

Accordingly, it is an object of the present invention to provide an ignition device which is for an internal combustion engine and which is reduced in size and cost and has a good mounting property. In the ignition device, an iron core, a primary coil wound around the core and a secondary coil electro-magnetically coupled to the primary coil are housed in a case. A control circuit for controlling a current flowing the primary coil is housed in the case so that heat generated by the circuit is transferred to the case to radiate out therefrom. For these reasons, the device is easily reduced in size, weight and cost and improved in mounting property.

DETAILED DESCRIPTION OF EMBODIMENT

An embodiment of the present invention is hereafter described in detail with reference to the drawings attached hereto.

Figure 1:
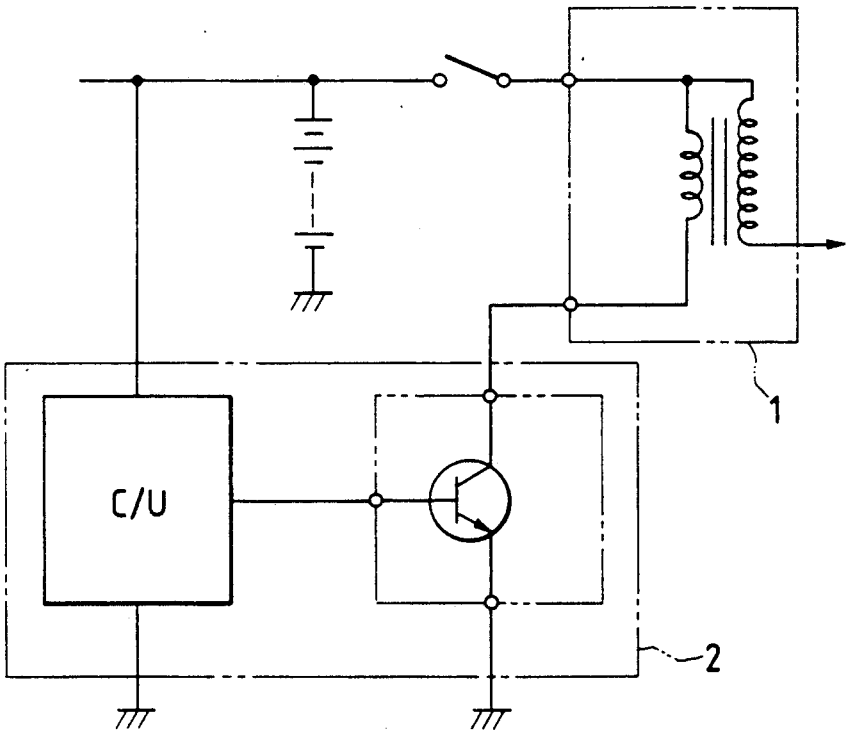
FIG. 1 is a diagram for describing the principle of the operation of a major part of a conventional ignition device for an internal combustion engine.
Figure 2:
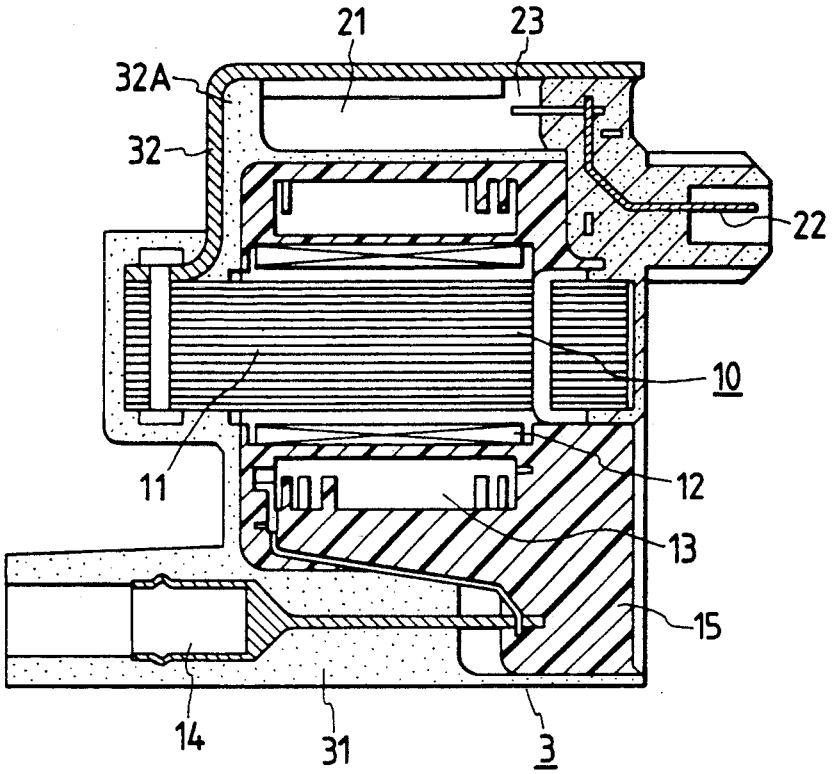
FIG. 2 is a sectional view of a major part of an ignition device which is an embodiment of the present invention and is for an internal combustion engine.
Figure 3:
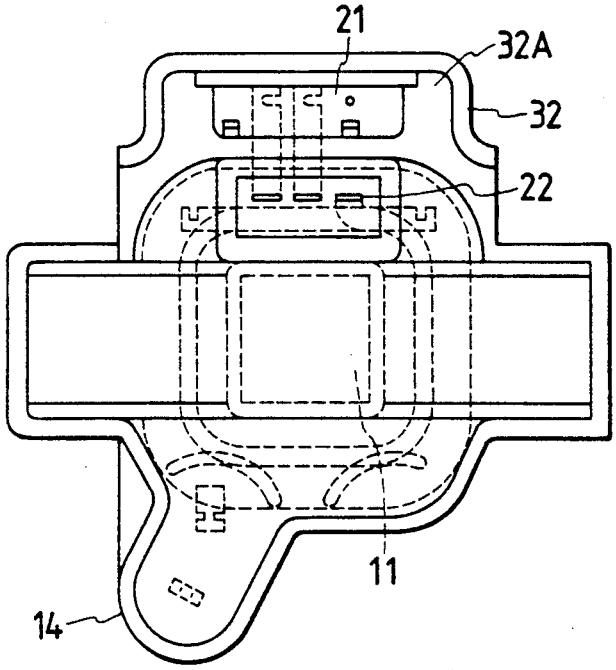
FIG. 3 is a front view of the ignition device.

FIG. 2 and 3 show an ignition device which is the embodiment for an internal combustion engine. The ignition device comprises an ignition coil unit 10 constituted a primary coil 12 and a secondary coil 13 which are wound around an iron core 11. An output terminal 14 is connected to the end of the secondary coil 13. The device also includes a case 3 composed of a first portion 31 made of an injection-molded electrically-insulating resin and surrounding the lower half of the ignition coil unit 10, and a second portion 32 made of a high-thermal-conductivity metal such as aluminum, iron, copper and an alloy of at least one of them and surrounding the upper half of the ignition coil unit. The first portion 31 of the case 3 supports the output terminals 14. The second portion of the case 3 has an internal opening space 32A in which a power transistor 21 for controlling the primary coil 12 is housed. The internal opening space 32A is filled with an electrically-insulating and heat-resistant gelled silicone 23 around the power transistor 21 so that heat generated by the transistor is well conducted to the second portion 32 of the case 3 through the filled silicone 23 and radiates out from the second portion. An opening space among the first portion 31 of the case 3, primary coil 12 and secondary coil 13 is filled with an epoxy resin. The power transistor 21 is connected to terminals 22 for applying a signal to the transistor. The control circuit of the ignition device includes the power transistor 21, and is basically the same as that of the above-described conventional ignition device, which is shown in FIG. 1. The control circuit of the ignition device which is the embodiment controls the ignition coil unit 10.

Since the ignition coil unit 10 and the power transistor 21 are housed in the same case 3, the ignition device is reduced in size, weight and cost and has a good mounting property.

Although the power transistor 21 is housed together with the ignition coil unit 10 in the case 3, another switching element or the entire control circuit including the transistor or the element may be housed together with the ignition coil unit in the case, instead.

The present invention is not confined to the above-described embodiment, but may be embodied or practiced in other various ways without departing the spirit or essential character thereof.

What is claimed is:

1. An ignition device for an internal combustion engine comprising:

an ignition coil unit including an iron core, a primary coil wound around said core, a secondary coil electro-magnetically coupled to said primary coil;

a case for housing said iron case, said primary coil and said secondary coil therein; and a control circuit for controlling a current flowing in said primary coil, wherein said control circuit is housed in said case so that heat generated by said control circuit is transferred to said case to radiate out therefrom;

wherein said case is composed of first portion made solely of an electrically insulating material and surrounding the lower half of said ignition coil unit for purposes of electrically protecting said coil and control circuit, and a second portion made of high-thermal-conductivity material and surrounding the upper half of said ignition coil unit and said control circuit.

2. An ignition device as claimed in claim 1, wherein said first portion is made of an injection-molded electrically-insulating resin, and a second portion is made of a high-thermal-conductivity metal.

3. An ignition device as claimed in claim 1, wherein a space among said first portion, said primary coil and said secondary coil is filled with an epoxy resin.

4. An ignition device as claimed in claim 1, wherein said second portion having an internal opening space filled with an electrically-insulating heat-resistant gelled silicone around said control circuit.

* * * * *